US007631705B1

(12) United States Patent
Harte et al.

(10) Patent No.: US 7,631,705 B1
(45) Date of Patent: Dec. 15, 2009

(54) ENHANCED SCREEN AUGER SAMPLING SYSTEM

(75) Inventors: Philip T. Harte, Concord, NH (US); Glenn A. Berwick, Epson, NH (US); Jeffrey B. Grey, Loudon, NH (US)

(73) Assignee: The United States of America as represented by the Secretary of the Interior, Washington, DC (US)

( * ) Notice: Subject to any disclaimer, the term of this patent is extended or adjusted under 35 U.S.C. 154(b) by 258 days.

(21) Appl. No.: 11/688,778

(22) Filed: Mar. 20, 2007

(51) Int. Cl.
*E21B 49/08* (2006.01)
*E21B 10/44* (2006.01)

(52) U.S. Cl. ..... 175/59; 175/323; 175/310; 175/394; 175/314; 175/20; 73/864.43

(58) Field of Classification Search ..... 73/864.43; 175/314, 20, 59, 310, 323, 394
See application file for complete search history.

(56) References Cited

U.S. PATENT DOCUMENTS 3,117,636 A * 1/1964 Wilcox et al. ..... 175/257
4,363,366 A 12/1982 Hilty
4,667,754 A 5/1987 Diedrich
4,886,432 A * 12/1989 Kimberlin ..... 417/478
5,337,838 A * 8/1994 Sorensen ..... 175/59
5,411,090 A * 5/1995 Cornette et al. ..... 166/278
5,673,762 A 10/1997 Pennington
5,743,343 A * 4/1998 Heller et al. ..... 175/20
6,035,950 A 3/2000 Heller et al.
6,101,871 A 8/2000 Schultz
6,470,967 B1 * 10/2002 Henry ..... 166/264

OTHER PUBLICATIONS

Taylor, T.W. and Serafini, M.C., "Screened Auger Sampling: The Technique and Two Case Studies," Ground Water Monitor Review, v.10, No. 4, pp. 145-152, Summer 1988.
Aller, Linda et al., "Handbook of Suggested Practices for the Design and Installation of Ground-Water Monitoring Wells," U.S. Environmental Protection Agency, EPA160014-891034, Mar. 1991, pp. i, 38-40, 64, 65, 141-149 <http:// www.epa.gov/region09/qa/pdfs/fieldsamp-wellshandbook.pdf>.

* cited by examiner

*Primary Examiner*—David J Bagnell
*Assistant Examiner*—Brad Harcourt
(74) *Attorney, Agent, or Firm*—Joan Gilsdorf

(57) ABSTRACT

A removable plug and collar for a hollow stem screened auger and a method of collecting water samples using the plug and collar. The plug has an outer threaded surface that is threaded in a first direction. The top of the plug has an internal threaded cavity that is threaded in a second direction opposite that of the first direction. The collar is pressure fit within the top of the screened auger, held in place with an auger bolt, and has an internal threaded surface to receive the plug. The plug has multiple ports to receive air and sample tubes, enabling samples to be collected without removing the plug from the screened auger. To set a well after sampling, the plug is removed from the collar down hole as a drill rod is threaded into the plug's internal threaded cavity in a direction the same as the second direction.

21 Claims, 7 Drawing Sheets

ENHANCED SCREEN AUGER SAMPLING SYSTEM

STATEMENT OF GOVERNMENT INTEREST

The invention described herein may be manufactured and used by or for the Government of the United States of America for government purposes without the payment of any royalties therefore.

BACKGROUND

1. Field of the Invention

The present invention relates in general to collection of ground-water samples during vertical profiling of ground-water quality in the subsurface and, more particularly, to a removable plug and collar system for use with a hollow stem screened auger.

2. Description of the Related Art

Hollow stem drilling augers are commonly used to bore holes in the earth to collect water and soil samples and to construct monitoring wells. A hollow stem auger has a cylindrical shape and an outer wall that is typically solid, but can be laser slotted or screened. An example of a screened auger 10 having slots 13 is shown in FIG. 1A. An example of a solid-wall auger 11 is shown in FIG. 1B. Hollow stem augers 10, 11 have a hollow center or passageway for receiving sampling tools. A cutting head or drilling bit 14 is attached to the bottom of the hollow stem auger 10, 11 to cut through soil. A continuous, helical flighting 12 is attached to the outer wall to lift the cut soil out of the bore hole. Hollow stem augers typically have an outside diameter of 6.25 inches (including the flighting) and a 3.25-inch inner diameter.

A series of hollow stem augers are connected end to end as the drilling process proceeds to form an auger column. FIG. 2 shows a typical hollow stem auger column 20. An uppermost auger 28 of the auger column 20 attaches to a drill rig (not shown) to rotate the auger column 20 into the soil. The drilling bit 14 is attached to the lowermost or leading auger. The auger column 20 provides a continuous bore from the surface level to the desired sample or drilling level. Boring and sampling tools are passed from the surface level through the hollow center of the auger column 20 to the desired depth. A single auger 10, 11 is typically 5 or 10 feet in length, enabling sampling of soil or water in aquifers at varying levels below the earth's surface.

When water is to be sampled, the screened auger 10 is used as the leading auger for the intake of ground fluids. The augers above the screened auger 10 are solid-wall augers 11. The augers 10, 11 are rotated and successively interconnected until the desired sampling level is reached. A sampler or submersible pump is lowered down the hollow stem to the screened auger 10 to collect a sample. To collect another sample at a different depth, the sampler or pump is removed, additional augers 11 are attached to the top of the auger column 20, and the augers 10, 11 are rotated down to the next desired level, where the sampling process is repeated. The sampler or pump must be retrieved prior to the connection of each additional auger 11 and then lowered once again after drilling to the next desired depth.

While drilling, formation materials can enter the hollow stem as the auger column 20 is advanced. Formation materials can be prevented from entering the hollow stem by inserting a center plug (not shown) at the bottom of the screened auger 10, which is knocked out and left in the ground prior to well installation or soil sampling. Formation materials can also be blocked by using a center rod assembly with an attached plug system (not shown) that is retrieved prior to well installation.

FIG. 3 illustrates how two adjacent augers in the auger column 20, such as the screened auger 10 and one of the solid-wall augers 11, are connected together. Opposite ends of each auger terminate in a socket end (female) connector 30 with a bolt hole 36 and a plug end (male) connector 32 with a bolt hole 38. As shown in FIG. 3, the socket end connector 30 of one of the solid-wall augers 11 receives the plug end connector 32 of the screened auger 10 until the socket end connector 30 contacts an auger stop 39. The joint between any two interconnected auger sections is secured using an auger bolt 34 to prevent the auger sections from slipping apart.

Collection of ground-water samples using conventional screened augers and submersible pumps is cumbersome and time consuming, and the reliability of the samples is questionable. At each sample depth, after the advancement of the screened auger into virgin aquifer, a pump must be lowered into the augers and placed at the depth of the screened auger. Because the screened auger, which is the first auger at the bottom of the auger column, is not isolated from the auger column above it, the pump is not isolated and water in the column above the screened auger can flow into the pump and jeopardize the reliability of the sample.

To provide a more reliable sample, an inflatable packer can be placed above the pump to isolate the water to be sampled from accumulated water in the hollow stem above the packer. The pump is turned on, water is purged from the isolated zone, and then a sample of the ground water is collected while the selected zone refills. However, with conventional auger drilling systems, it is necessary to lower the pump, inflate the packer, collect the sample, deflate the packer, and then remove the pump with the addition of each auger to further advance the bottom screened auger and collect a sample. For each new sample collected at a deeper depth, the process must be repeated. These operations are time-consuming and disturb the water column within the augers, which compromises the reliability of the sample.

Thus, there is a need for a system and method for reliable, efficient, and continuous collection of samples using a screened auger that prevents water above the screened auger from flowing into the pump within the screened auger, while allowing the installation of a monitoring well after vertical profiling, if desired.

SUMMARY

A removable plug and collar system and a method of collecting water samples using the plug and collar system are disclosed for use with a standard hollow stem screened auger. The plug has a cylindrical shape and an outer threaded surface with threads surrounding the outer threaded surface in a first direction (e.g., left-hand threads). The top of the plug has an internal threaded cavity that is threaded in a second direction (e.g., right-hand threads) opposite that of the first direction. The outer surface of the collar is pressure fit within the top of the hollow stem screened auger and secured in place with a conventional auger bolt. The collar has an internal threaded surface to receive the plug. The plug is removed from the collar as a drill rod is threaded into the internal threaded cavity of the plug in a direction the same as the second direction.

The plug and collar system of the present disclosure, in combination with the conventional center plug placed at the bottom of the screened auger, provides the ability to seal both the top and bottom of the screened auger so that more reliable samples can be collected. The plug of the present disclosure has a top member, which includes the outer threaded surface, and an elongated bottom member extending from the lower surface of the top member. The unique shape of the plug of the present disclosure allows for the attachment of a slim-line bladder pump to the plug. The plug has a multiple port system to attach tubes, such as air tubes and sample tubes, to the plug so that the samples can be collected without needing to remove the plug. The ports are threaded to accept standard size ferrule connections.

The ability to leave the plug in place during sampling provides many advantages, including, for example, the ability to (1) reduce or eliminate the flow of water above the screened auger into the bladder pump; (2) obtain more reliable and representative ground water quality samples than has previously been possible using screened augers and auger rig drilling; (3) reduce the volume of water needed to collect representative samples; and (4) decrease the time needed to collect multiple ground-water samples from different depths while profiling with a screened auger. Also, the dual left- and right-hand box threading of the plug (i.e., the direction of the threads on the outer surface of the plug is opposite the direction of the threads in the internal threaded cavity of the plug) allows for its down hole removal using standard A-rod drill stems so that a monitoring well can be set after sampling.

Various aspects and advantages will become apparent from the following detailed description, taken in conjunction with the accompanying drawings, which are not necessarily drawn to scale.

DESCRIPTION

The present disclosure describes a removable plug and collar system that fits within the upper end of the conventional hollow stem screened auger 10. The plug and collar system isolates the water column above the screened auger 10 from the water within the screened auger 10 so that representative water samples can be collected from the screened auger 10.

Figure 4:
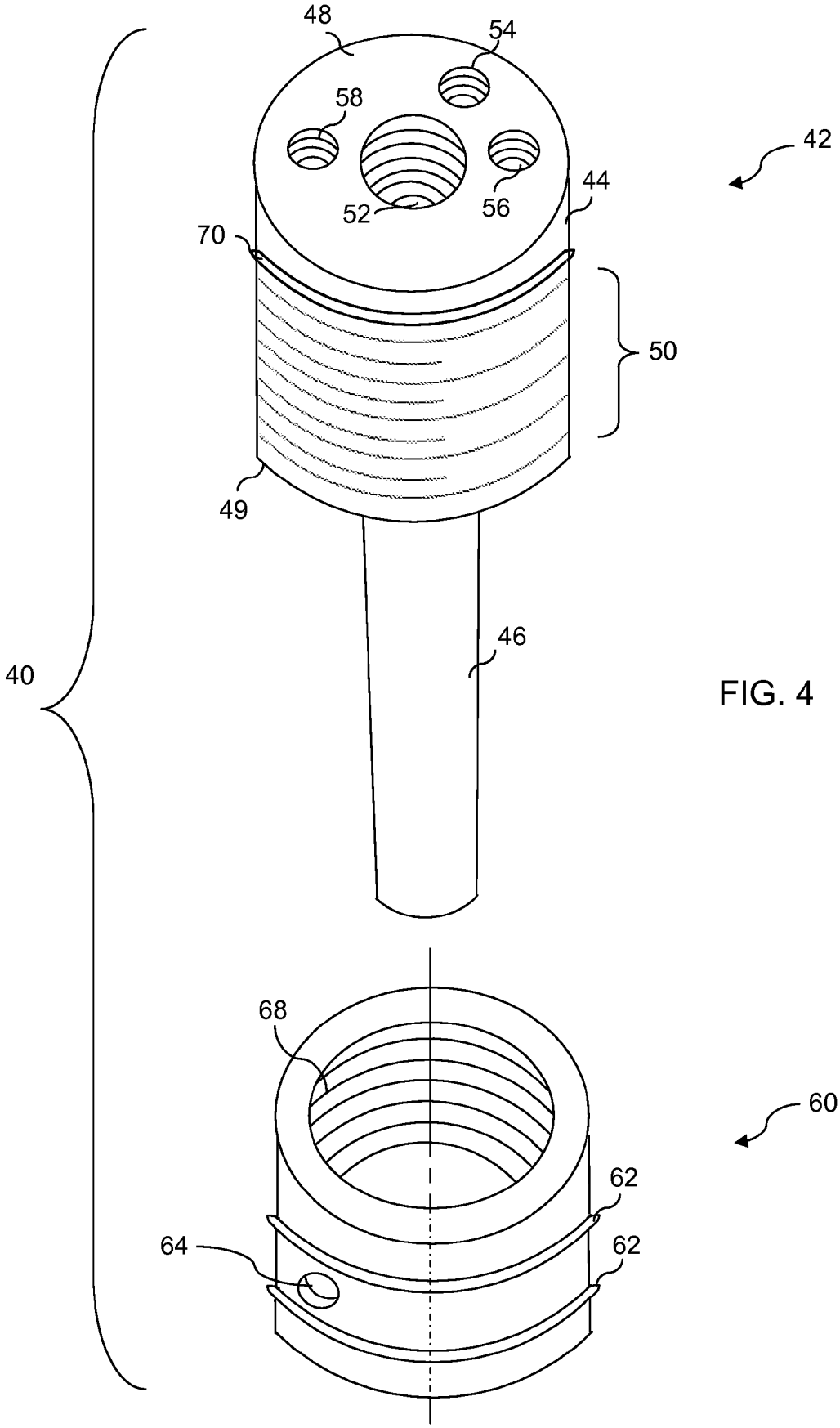
FIG. 4 is an exploded perspective view of a plug and collar system, in accordance with the present disclosure.

Referring now to FIG. 4, there is shown a perspective view of a removable plug and collar system 40, including a plug 42 and a collar 60. The plug 42 has a top member 44 and a bottom member 46, both members having a cylindrical shape. The top member 44 has an upper end 48 and a lower end 49. An O-ring collar 70 fits within a groove 72 (see FIG. 5) on the outer cylindrical surface of the top member 44 of the plug 42 to prevent leakage of fluids. The outer cylindrical surface of the top member 44 of the plug 42 has threads 50 that surround the outer cylindrical surface in a first direction. For example, the outer cylindrical surface of the top member 44 may be left-hand threaded. The upper end 48 of the top member 44 has an internal plug cavity 52 that is threaded in a second direction opposite that of the outer cylindrical surface. For example, the internal plug cavity 52 may be right-hand threaded. The internal plug cavity 52 receives a drilling tool, such as a drill rod 82 (see FIG. 7), for removal of the plug 42 from the collar 60.

Figure 7:
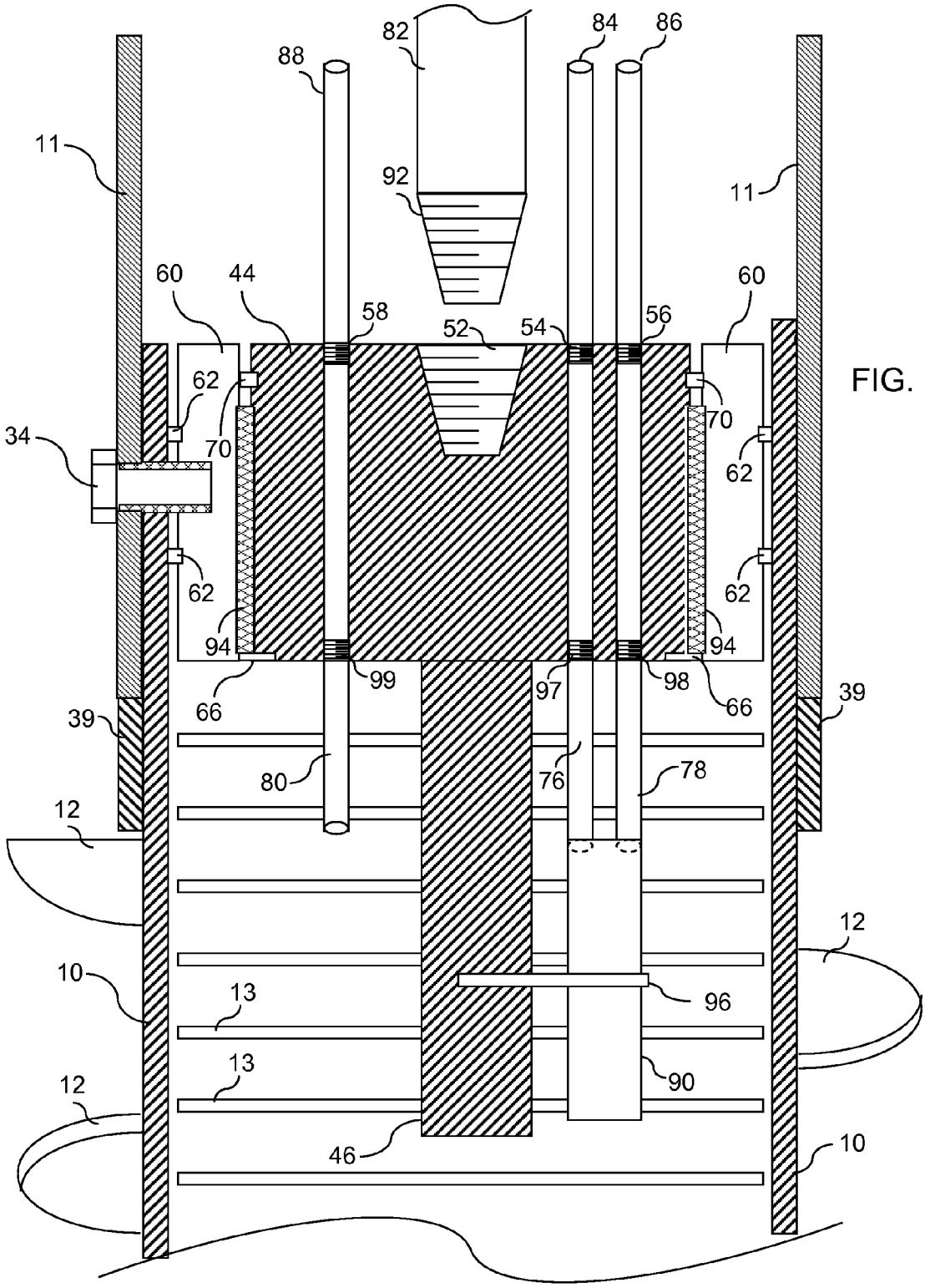
FIG. 7 is a cross-sectional view of the plug and collar system of FIG. 4, placed in the top of the hollow stem screened auger of FIG. 1A.

The top member 44 of the plug 42 has multiple passageways or port hole columns bored through the height of the top member 44, each port hole column having a port on the upper end 48 and the lower end 49 of the top member 44. Three ports 54, 56, 58 are shown on the upper end 48 in FIG. 4 to receive an air tube 84, a sample tube 86, and an optional injection tube 88 (see FIG. 7). Companion ports 97, 98, 99 are shown in FIG. 7. All of the ports 54, 56, 58 and their companion ports 97, 98, 99 are threaded holes to accept ferrule connections (not shown), which fit a minimum tubing diameter size of about 0.25 inches.

Figure 3:
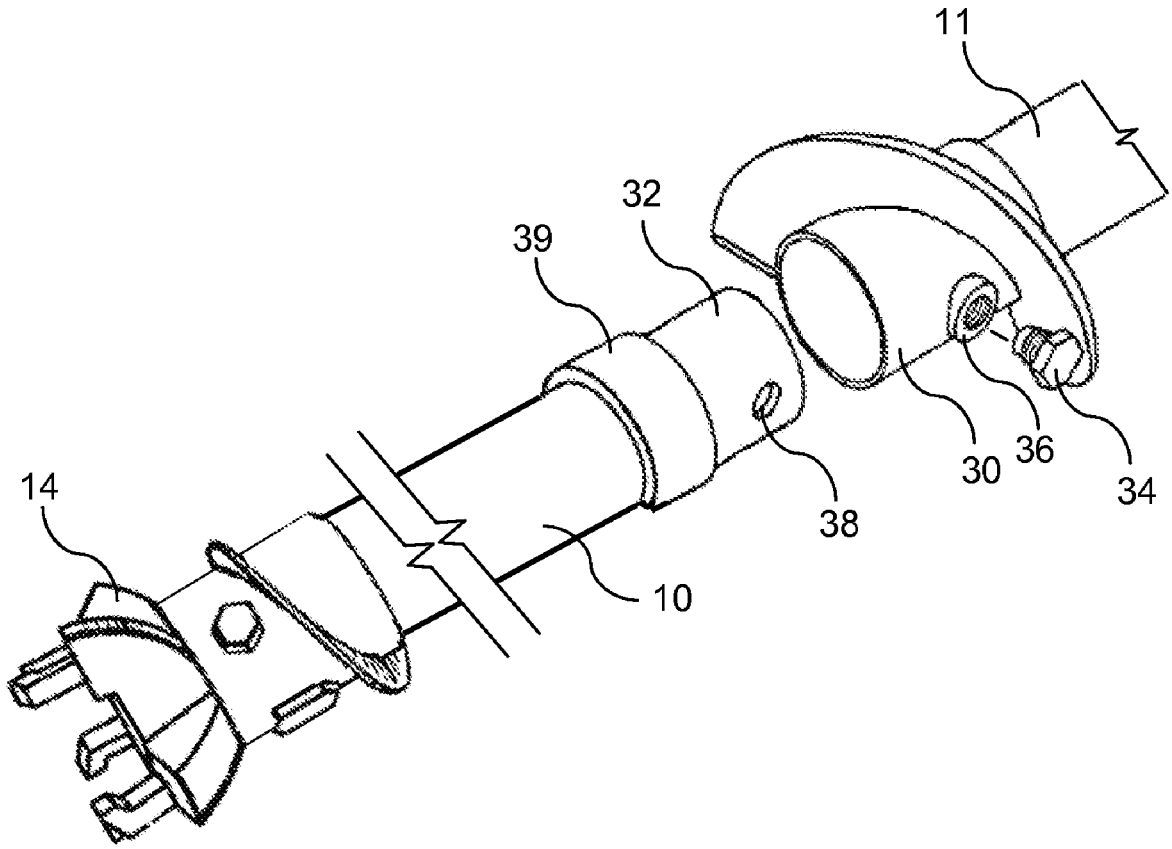
FIG. 3 PRIOR ART
FIG. 3 is a perspective view of the joint between two adjacent augers of the types illustrated in FIG. 1A and FIG. 1B, according to the prior art.

As shown in FIG. 4, one or more O-rings 62 are placed around an outer surface of the collar 60 to pressure fit the collar 60 into the top of the screened auger 10. The collar 60 has grooves 74 (see FIG. 5) to accept the O-rings 62. The collar 60 is hollow and has a bolt hole 64 on one side of the collar 60 to accommodate the auger bolt 34 (see FIG. 3) that firmly holds the collar 60 in place within the screened auger 10. An internal surface 68 of the collar 60 is threaded in the first direction to receive the top member 44 of the plug 42.

Figure 5:
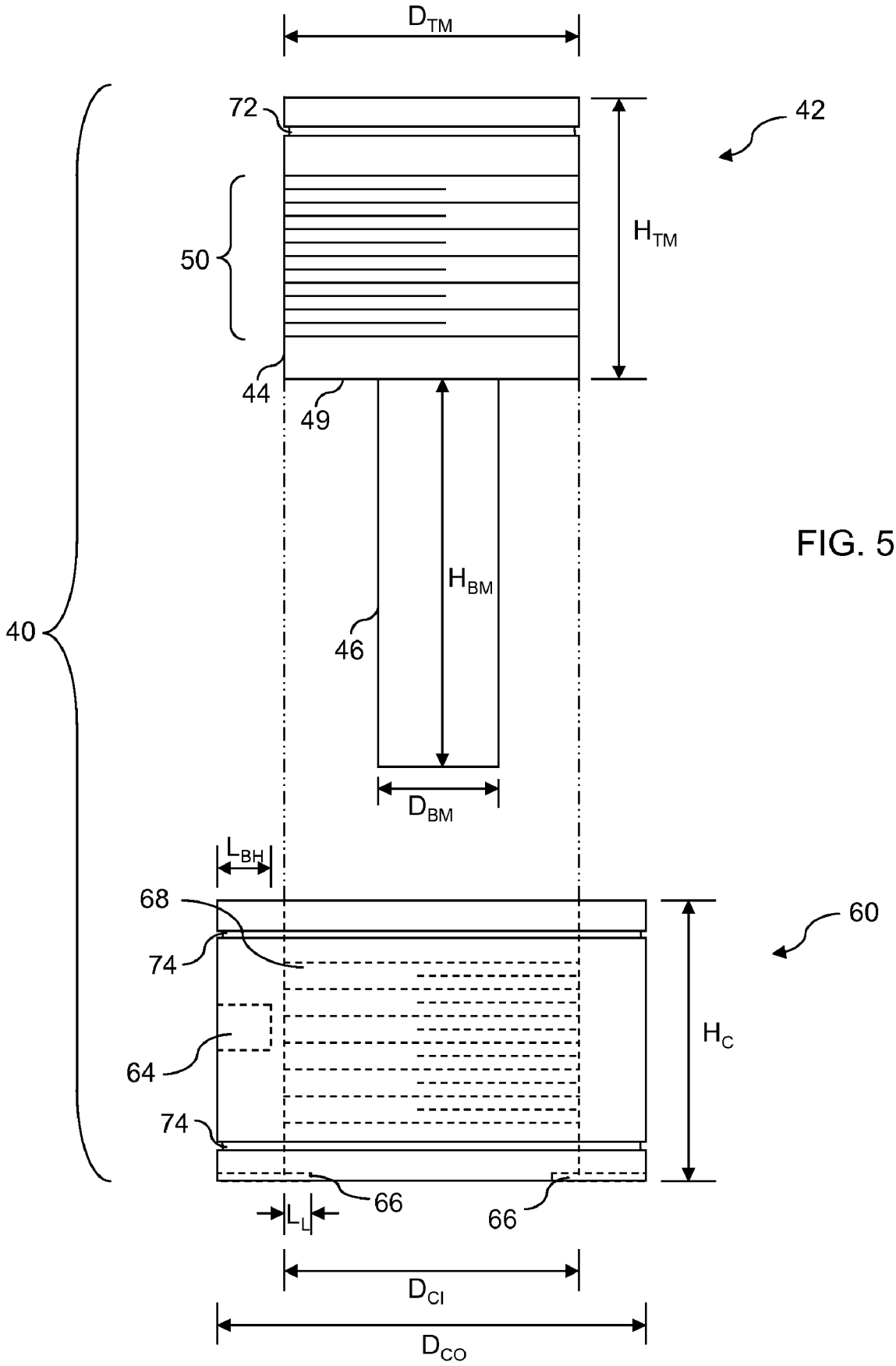
FIG. 5 is an exploded side view of the plug and collar system of FIG. 4.
Figure 6:
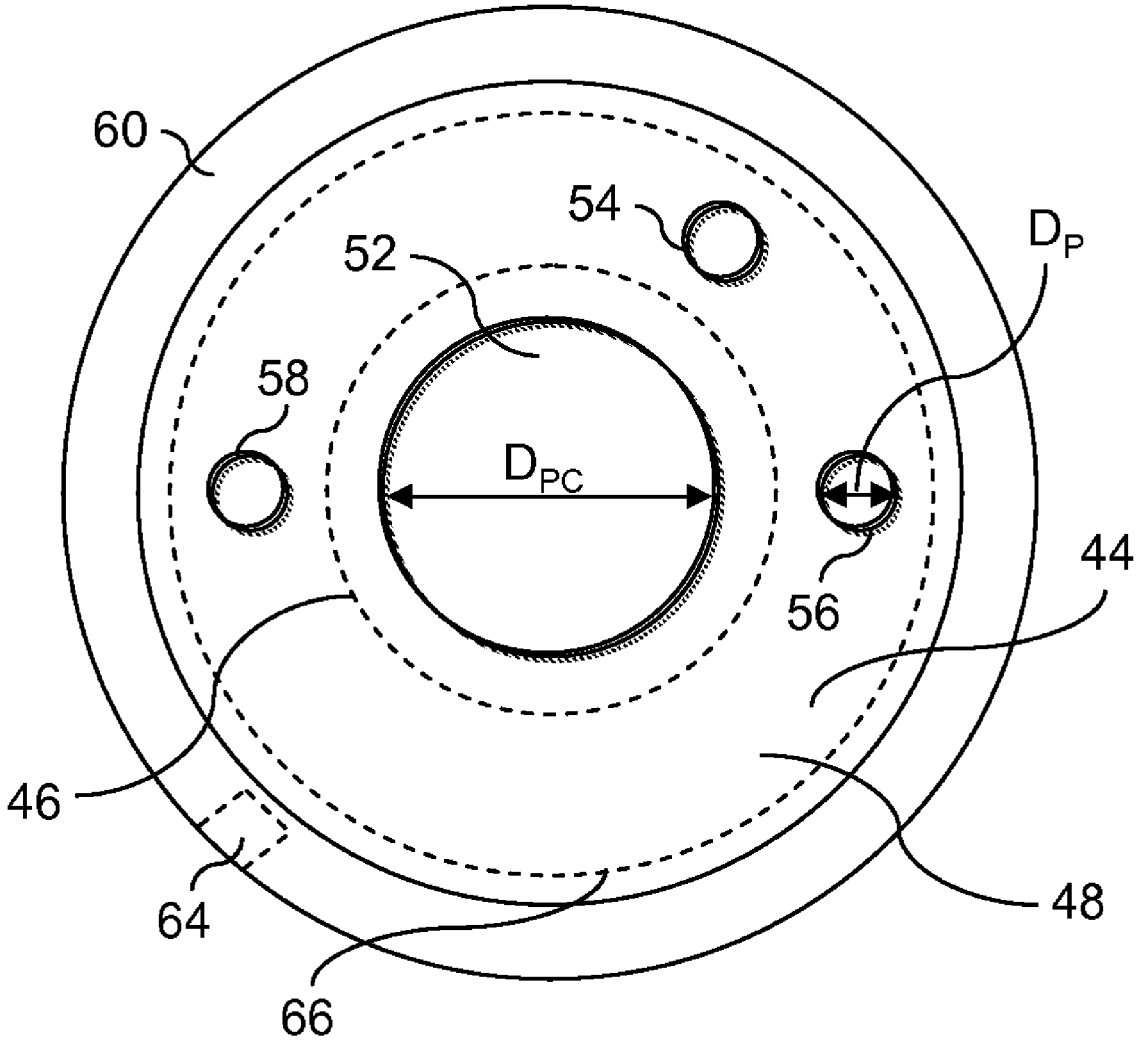
FIG. 6 is a top view of the plug and collar system of FIG. 4.

FIGS. 5 and 6 illustrate a side view and a top view, respectively, of the plug and collar system 40. As shown in FIG. 5, the top member 44 of the plug 42 has an outer diameter $D_{TM}$ of about 2.75 inches and a height $H_{TM}$ of about 3 inches. The bottom member 46 of the plug 42 is elongated and has a diameter $D_{BM}$ of about 1.5 inches and a height $H_{BM}$ of about 24 inches. The collar 60 has an outer diameter $D_{CO}$ of about 3.125 inches, an inner diameter $D_{CI}$ of about 2.75 inches, and a height $H_C$ of about 3 inches. A lip 66 on the bottom of the collar 60 protrudes a length $L_L$ of about 0.125 inches from the internal surface 68 of the collar 60 into the hollow interior of the collar 60 to prevent the lower end 49 of the top member 44 of the plug 42 from being screwed below the bottom of the collar 60. The bolt hole 64 is located about one-inch below the top of the collar 60 and partially penetrates the collar 60 to a distance $L_{BH}$ of about 0.125 inches.

Referring to FIG. 6, each of the ports 54, 56, 58 (and each of the companion ports 97, 98, 99) has a diameter $D_P$ of about 0.275 inches to receive ferrule connectors that accommodate the air tube 84, the sample tube 86, and the optional injection tube 88. Each tube 84, 86, 88 has a diameter of about 0.25 inches. The plug cavity 52 has an outer diameter $D_{PC}$ of about 1.75 inches and is shaped to accommodate a bottom end of the standard drill rod 82.

The dimensions of the plug 42 and the collar 60 described above are provided to fit the conventional 3.25-inch inner diameter screened auger 10. However, the dimensions of the plug 42 and the collar 60 can be modified to accommodate screened augers of various sizes.

FIG. 7 shows a cross-sectional view of the assembled plug and collar system 40 within the top of the screened auger 10. To assemble the plug and collar system 40, the O-ring collar 70 is placed in the groove 72 on the top member 44 of the plug 42. The bottom member 46 of the plug 42 is inserted through the collar 60 and the top member 44 is left-hand box-threaded into the collar 60 until contacting the lip 66 at the bottom of the collar 60. The O-rings 62 are placed around the outside of the collar 60. The air tube 84, the sample tube 86, and the optional injection tube 88 are connected to ports 54, 56, 58 respectively and secured by the ferrule connections that thread into the ports 54, 56, 58. Lower tubes 76, 78, which are the companion tubes to the air tube 84 and the sample tube 86, respectively, are connected to ports 97, 98 and secured by ferrule connections (not shown). An optional lower tube 80, which is a companion tube to the optional injection tube 88, may be connected to port 99 and secured by a ferrule connection (not shown). The lower tubes 76, 78, 80 extend into the screened auger 10.

A conventional down-hole, slim-line bladder pump 90 is attached to the bottom end of lower tubes 76, 78. The conventional bladder pump 90 shown in FIG. 7 has an outer diameter of about 0.875 inches and a length of about 18 inches. The bladder pump 90 is attached to the bottom member 46 of the plug 42 using a connector 96, such as a clamp or U-bolts, to securely hold the bladder pump 90 within the screened auger 10. The height $H_{BM}$ of the bottom member 46 of the plug 42 can vary as long as the length is sufficient to allow the bladder pump 90 to be secured to the side of the bottom member 46 of the plug 42. The lower tubes 76, 78, 80 are constructed of plastic or other non-corrosive materials. For example, the lower tubes 76, 78, 80 can be constructed of stainless steel to add rigidity to the pump assembly. The plug 42 and the collar 60 may be constructed of stainless steel or other durable, water-resistant, non-corrosive materials.

The collar 60 is pressure fit into the top of the screened auger 10. A solid-wall hollow stem auger 11 is slipped over the top of the screened auger 10 and held in place by the auger bolt 34, which is placed through the bolt hole 36 in the solid-wall auger 11, the bolt hole 38 in the screened auger 10, and the bolt hole 64 in the collar 60.

Alternatively, the plug and collar system 40 can be assembled by first placing the O-rings 62 around the outside of the collar 60 and pressure fitting the collar 60 into the top of the screened auger 10. The bladder pump 90 is then attached to the bottom member 46 of the plug 42 using the connector 96. The lower tubes 76, 78 are connected to ports 97, 98, and the bladder pump 90 is attached to the bottom end of the lower tubes 76, 78. The optional lower tube 80 may be connected to port 99 if the optional injection tube 88 is used. The O-ring collar 70 is placed in the groove 72 on the top member 44 of the plug 42. The bottom member 46 of the plug 42 is inserted through the collar 60 and the top member 44 is left-hand box-threaded into the collar 60 until contacting the lip 66 at the bottom of the collar 60. The air tube 84, the sample tube 86, and the optional injection tube 88 are connected to ports 54, 56, 58 respectively and secured by the ferrule connections that thread into the ports 54, 56, 58. A solid-wall hollow stem auger 11 is slipped over the top of the screened auger 10 and held in place by the auger bolt 34.

Figure 1A:
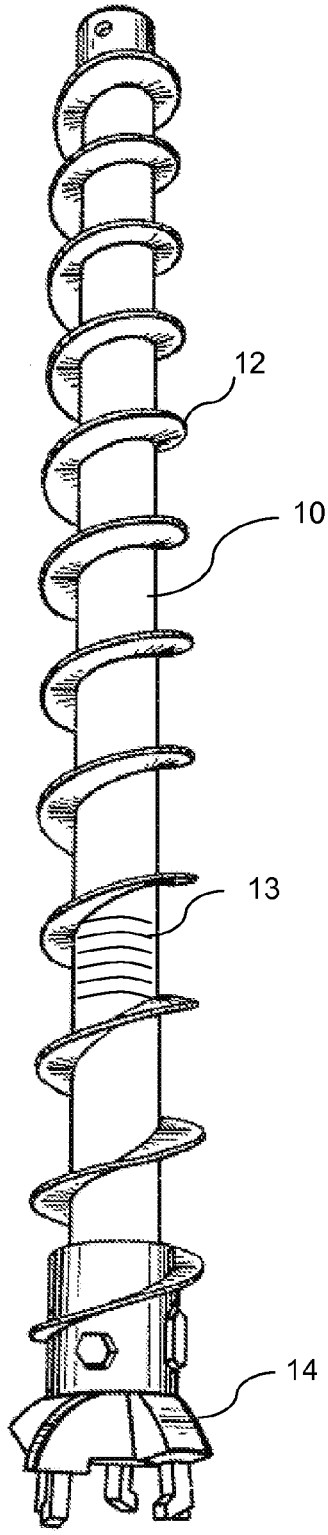
FIG. 1A PRIOR ART
FIG. 1A is a perspective view of a hollow stem screened auger, according to the prior art.
Figure 1B:
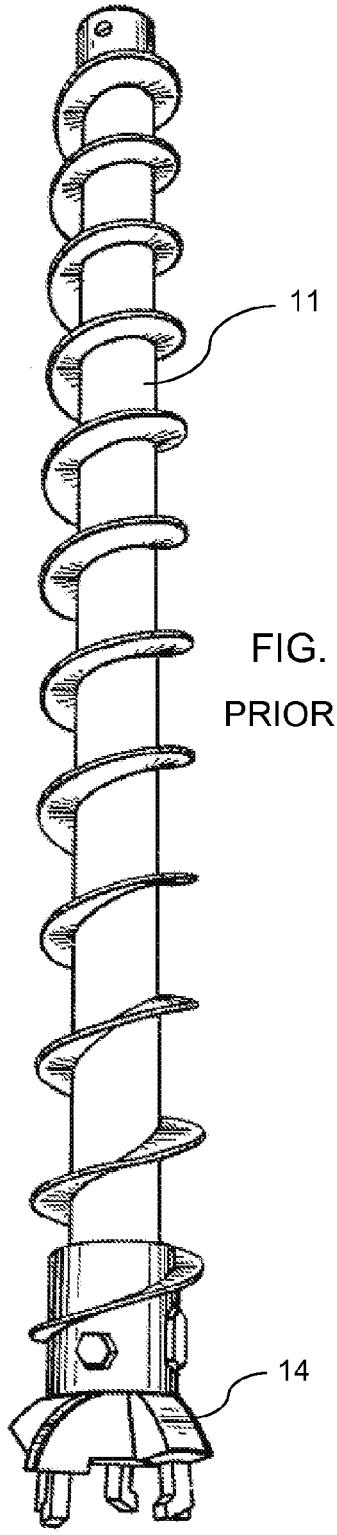
FIG. 1B PRIOR ART
FIG. 1B is a perspective view of a solid-wall hollow stem auger, according to the prior art.
Figure 2:
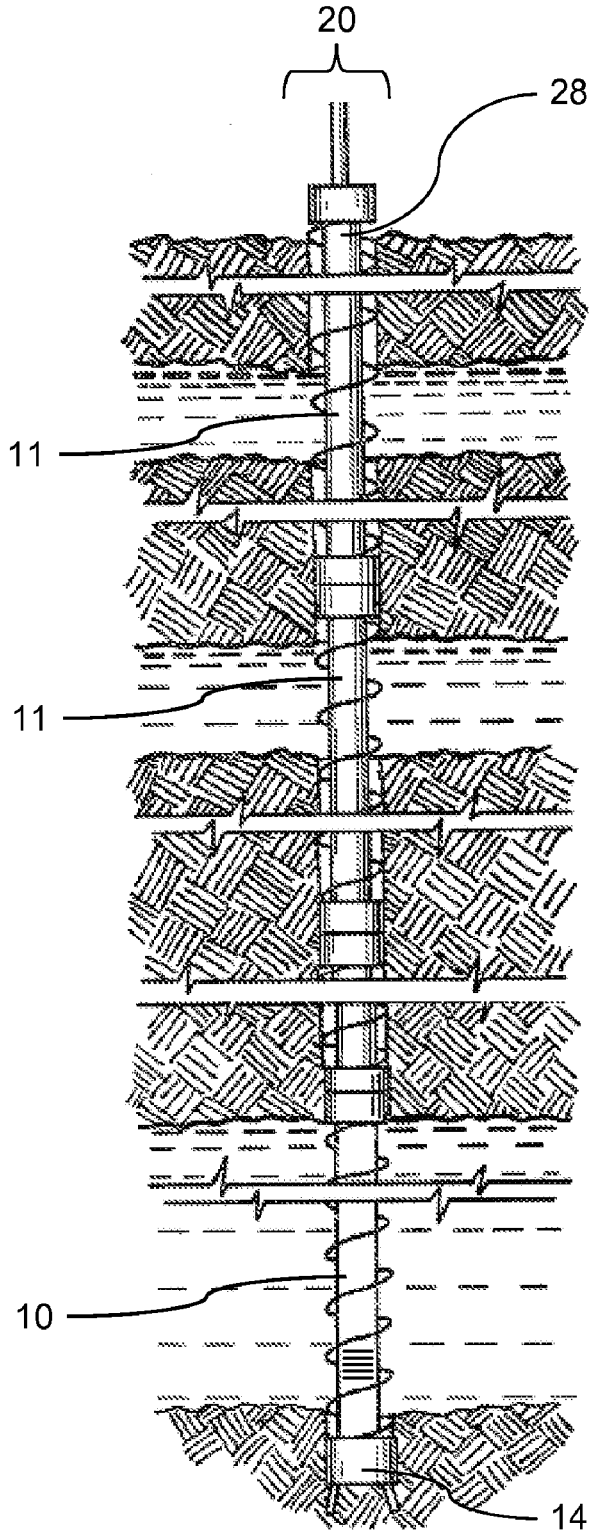
FIG. 2 PRIOR ART
FIG. 2 illustrates an auger column, according to the prior art.

Additional solid-wall augers 11 are added to the auger column 20 to advance the screened auger 10 to the desired sampling level. As each new auger 11 is added to the auger column 20, new tube sections (not shown) are added to the tops of the tubes 84, 86, 88 to extend the tubes 84, 86, 88. Each tube section has about the same length as each auger section. Each tube section is attached to a previous tube section using standard threaded ferrule connections. Thus, the tubes 84, 86, 88 are attached to the ports 54, 56, 58 in the plug 42 and extended as each new auger 11 is added so that the tubes 84, 86, 88 run up the auger column 20 to the surface. The top ends of the tubes 84, 86, 88 are attached to the uppermost auger 28 (see FIG. 2) with a clip (not shown), for example. Each time a new auger section 11 is added, the top ends of the new tube sections are reattached to the new uppermost auger 28.

After the auger column 20 is advanced to the desired sampling level, the uppermost auger 28 is disconnected from an auger bell (not shown), which turns the auger column 20 into the ground, and the upper ends of the air tube 84 and the sample tube 86 are respectively connected above ground to a power supply (airline or air source (not shown)) and to a sample collection device (not shown). The air tube 84 is used to expand a bladder inside the bladder pump 90 and push, through positive displacement, the sample fluid up the lower tube 78, through the passageway connecting port 98 to port 56, and up the sample tube 86 to the sample collection device. Alternatively, a peristaltic pump (not shown) located above ground may be used to collect samples, rather than the bladder pump 90. If a peristaltic pump is used, it does not need to be attached to the bottom member 46 of the plug 42, and only one tube (the sample tube 86) is attached to the peristaltic pump at the surface level. The lower companion tube 78 is attached to the companion port 98, and the fluid sample is withdrawn through negative displacement to the surface.

To collect additional samples, another solid-wall auger 11 and accompanying new tube sections for attachment to the tubes 84, 86, 88 are added to the auger column 20, the newly added uppermost auger 28 is reattached to the auger bell, and the screened auger 10 is lowered to the next desired sampling level. After all the ground-water samples are collected, the plug 42 (along with the bladder pump 90, the lower tubes 76, 78, 80, and the tubes 84, 86, 88) is removed using the conventional drill rod 82, such as an A-rod, so that a well can be set, if desired, through the auger column 20 using standard well drilling methods. The collar 60 remains in the auger column 20, but can be removed after the well is set and the auger column 20 has been removed from the well.

The conventional A-rod 82 shown in FIG. 7 has an outer diameter of about 1.75 inches, a female threaded section at the top (not shown) to connect to the drill rig, and a male threaded section 92 at the lower end that is about 2 inches long and tapers to a diameter of about 1.25 inches. The plug 42 is removable because it is left-hand box threaded into the collar 60 (forming a reverse-threaded plug and collar junction 94), whereas the A-rod 82 is right-hand box threaded into the plug cavity 52 in the top member 44 of the plug 42. As the A-rod 82 is threaded into the plug 42, the plug 42 is removed from the collar 60 because of its reverse thread.

The above disclosure describes a removable plug and collar system that fits into a standard hollow stem screened auger. The plug and collar system of the present disclosure, in combination with the conventional center plug placed at the bottom of the screened auger, provides the ability to seal both the top and bottom of the screened auger so that more reliable samples can be collected. The unique shape of the plug of the present disclosure allows for the attachment of a slim-line bladder pump to the plug and the collection of positive displacement ground water samples. The plug of the present disclosure has multiple passageways with ports to attach tubes, such as air tubes and sample tubes, so that water samples can be collected without removing the plug. The ability to leave the plug in place during sampling provides many advantages, including, for example, the ability to (1) reduce or eliminate the flow of water above the screened auger into the bladder pump; (2) obtain more reliable and representative ground water quality samples than has previously been possible using screened augers and auger rig drilling; (3) reduce the volume of water needed to collect representative samples (evacuation of a large volume of water also presents disposal problems and sometimes can be time consuming, thereby inflating costs); and (4) decrease the time needed to collect multiple ground-water samples from different depths while profiling with a screened auger. Also, the dual left- and right-hand box threading of the plug allows for its down hole removal using standard A-rod drill stems so that a monitoring well can be set after sampling, if desired.

The present invention has been described with respect to the collection of samples for the detection and monitoring of hazardous and toxic waste contained in subsurface aquifers. The invention has broad application in test-well drilling and profiling of ground-water quality in the subsurface using auger rig drilling. The present invention may also be used to profile permeability variations in the subsurface by use of hydraulic testing so as to assist in the optimal vertical placement of domestic gravel packed wells. It can also be used to identify problematic water-quality conditions associated with domestic well water quality by identifying water-quality conditions prior to well installation. At sites where identification of solute transport parameters is important, the optional injection tube 88 can be used to inject tracers and perform push-pull tracer experiments.

In addition, the plug and collar system described above, which isolates the water column above the screened auger from the water within the screened auger, can be used with pressure transducers and other downhole probes (not shown) to monitor ambient downhole conditions if designed in conjunction with swivel type auger connections (not shown) at the drill rig. This enables the continuous monitoring of pressure or other parameters while auger drilling.

It will be appreciated by those skilled in the art that modifications and variations of the present invention are possible without departing from the principles and spirit of the invention, the scope of which is defined in the appended claims and their equivalents.

What is claimed is:

1. A removable plug and collar system to aid collection of subterranean fluid samples using a hollow stem auger column having a leading screened auger and a drill rod, comprising:

a removable collar attached to a top inner surface of the screened auger and having an internal threaded surface;

a removable plug that is self-contained to isolate a fluid column above the screened auger from a fluid column within the screened auger, the plug comprising a top member having a cylindrical shape and an outer threaded surface with threads surrounding the outer threaded surface in a first direction, and an internal threaded cavity in a top of the plug that is threaded in a second direction opposite that of the first direction, the plug being secured to the collar by the outer threaded surface of the plug engaging the internal threaded surface of the collar, and a bottom member attached to the top member and having an elongated cylindrical shape, the top member being threaded into the collar and the bottom member extending below a bottom of the collar; and a pump attached to the bottom member of the plug to hold the pump in place within the screened auger, wherein the plug is removed from the collar after drilling and sampling are completed by threading the drill rod into the internal threaded cavity in a direction the same as the second direction.

2. The removable plug and collar system of claim 1, wherein the outer threaded surface of the top member of the plug is left-hand threaded and the internal threaded cavity of the top member of the plug is right-hand threaded.

3. The removable plug and collar system of claim 1, wherein the top member of the plug further comprises one or more passageways extending through a height of the top member, each passageway having an upper port and a lower port to receive upper tubes and corresponding lower companion tubes, the upper tubes extending above the screened auger to a surface and the lower companion tubes extending below the top member and into the screened auger.

4. The removable plug and collar system of claim 3, wherein the upper tubes and the lower companion tubes comprise an air tube and a sample tube.

5. The removable plug and collar system of claim 4, wherein the upper tubes and the lower companion tubes further comprise an injection tube.

6. The removable plug and collar system of claim 4, wherein the pump is a slimline bladder pump connected to lower ends of the companion tubes of the air tube and the sample tube.

7. The removable plug and collar system of claim 1, wherein the top member of the plug further comprises an O-ring collar that fits around a groove in an upper end of the top member.

8. The removable plug and collar system of claim 1, wherein the plug is left-hand threaded into the collar to form a reverse-threaded plug and collar junction between the plug and the collar and the drill rod is right-hand threaded into the internal threaded cavity of the plug to remove the plug from the collar.

9. The removable plug and collar system of claim 1, wherein the collar further comprises a lip on a bottom end of the collar and extending inward from the internal threaded surface of the collar, the plug being threaded into the collar until contacting the lip.

10. The removable plug and collar system of claim 1, further comprising one or more O-rings wrapped around an external surface of the collar to pressure fit the collar into the top of the screened auger.

11. The removable plug and collar system of claim 10, further comprising a bolt hole through the external surface of the collar to receive an auger bolt that holds the collar in place within the screened auger.

12. The removable plug and collar system of claim 1, wherein the plug and the collar are constructed of stainless steel.

13. A method of collecting water samples using a hollow stem screened auger and a drill rod, comprising:

forming a plug and collar assembly, comprising, threading a removable plug having a top member with multiple passageways and an elongated removable bottom member with a diameter smaller than a diameter of the top member into a collar in a first direction by inserting the bottom member through the collar and threading the top member into the collar with the bottom member extending below a bottom of the collar, attaching tubing to one or more of the passageways, and connecting a pump to the tubing and to the bottom member of the plug to hold the pump in place within the hollow stem screened auger;

inserting the plug and collar assembly into a top of the hollow stem screened auger and attaching the collar to the inside of the top of the hollow stem screened auger;

attaching an auger column to the top of the hollow stem screened auger;

lowering the hollow stem screened auger to a desired sampling level by advancing the auger column, without removing the plug and collar assembly;

collecting a sample;

repeatedly lowering the hollow stem screened auger by advancing the auger column, without removing the plug and collar assembly, and collecting additional samples until a desired number of samples has been collected; and removing the plug from the hollow stem screened auger by threading a drill rod into an internal threaded cavity in a top of the plug in a second direction opposite the first direction.

14. The method of claim 13, wherein:

said attaching tubing to one or more of the passageways comprises attaching an air tube and a sample tube to two of the passageways;

said connecting a pump to the tubing comprises attaching a bladder pump to lower ends of the air tube and the sample tube; and said collecting a sample comprises using the air tube to expand the bladder pump and push, through positive displacement, the sample up the sample tube to a surface level.

15. The method of claim 13, wherein:

said attaching tubing to one or more of the passageways comprises attaching a sample tube to one of the passageways;

said connecting a pump to the tubing comprises attaching a peristaltic pump to an upper end of the sample tube at a surface level; and said collecting a sample comprises using negative displacement to withdraw the sample to the surface level through the sample tube.

16. The method of claim 13, wherein said threading the plug into the collar in a first direction comprises left-hand threading the plug into the collar, forming a reverse-threaded plug and collar junction.

17. The method of claim 16, wherein said threading a drill rod into an internal threaded cavity in a top of the plug in a second direction opposite the first direction comprises right-hand threading the drill rod into the internal threaded cavity of the plug.

18. The method of claim 13, wherein said attaching the collar to the top of the hollow stem screened auger comprises placing one or more O-rings around an external surface of the collar and pressure fitting the collar into the hollow stem screened auger.

19. The method of claim 13, wherein said repeatedly lowering the hollow stem screened auger comprises adding solid-wall hollow stem augers to the hollow stem screened auger to form the auger column, adding a sufficient number of the solid-wall hollow stem augers to reach each desired sampling level, and adding additional tubing to extend the tubing from the screened auger to a surface level.

20. The method of claim 13, further comprising installing a well after removing the plug by inserting well pipe through the vacated plug area.

21. The method of claim 13, further comprising reinserting the plug as desired to continue advancing or to retract the auger column and collect additional samples at desired depths, prior to installation of a well.

* * * * *